US006833772B1

(12) United States Patent
Brown et al.

(10) Patent No.: US 6,833,772 B1
(45) Date of Patent: Dec. 21, 2004

(54) RF SWITCH USING CONDUCTIVE FLUID

(75) Inventors: Stephen B. Brown, Palm Bay, FL (US); James J. Rawnick, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/648,913

(22) Filed: Aug. 27, 2003

(51) Int. Cl.[7] ..... H01P 1/10; H01P 5/12
(52) U.S. Cl. ..... 333/108; 333/258
(58) Field of Search ..... 333/258, 108, 333/101

(56) References Cited

U.S. PATENT DOCUMENTS 4,580,113 A * 4/1986 Pinson ..... 333/81 B
4,604,592 A * 8/1986 Pinson ..... 333/24.1
5,792,236 A 8/1998 Taylor et al.

OTHER PUBLICATIONS

U.S. patent application Ser. No. 10/330,756, Rawnick et al., filed Dec. 27, 2002.
U.S. patent application Ser. No. 10/626,090, Brown et al., filed Jul. 24, 2003.
U.S. patent application Ser. No. 10/632,632, Rawnick et al., filed Aug. 1, 2003.
U.S. patent application Ser. No. 10/625,977, Rawnick et al., filed Jul. 24, 2003.
U.S. patent application Ser. No. 10/614,149, Brown et al., filed Jul. 7, 2003.
U.S. patent application Ser. No. 10/634,219, Rawnick et al., filed Aug. 5, 2003.
U.S. patent application Ser. No. 10/620,483, Brown et al., filed Jul. 16, 2003.
U.S. patent application Ser. No. 10/414,695, Rawnick et al., filed Apr. 16, 2003.
U.S. patent application Ser. No. 10/624,378, Brown et al., filed Jul. 22, 2003.
U.S. patent application Ser. No. 10/460,947, Rawnick et al., filed Jun. 13, 2003.
U.S. patent application Ser. No. 10/421,305, Rawnick et al., filed Apr. 23, 2003.
U.S. patent application Ser. No. 10/640,237, Rawnick et al., filed Aug. 13, 2003.
U.S. patent application Ser. No. 10/648,887, Rawnick et al., filed Aug. 27, 2003.

* cited by examiner

*Primary Examiner*—Stephen E. Jones
(74) *Attorney, Agent, or Firm*—Sacco & Associates PA

(57) ABSTRACT

An RF switch (100) which includes a waveguide structure (102) having at least a first (104) and second port (106). The RF switch (100) also includes a dielectric structure defining at least a first cavity (136) disposed at a juncture between the first and second ports. The dielectric structure can define a plurality of elongated fluid cavities (136) at the juncture extending between opposing walls (116, 118) of the waveguide structure (102). The RF switch (100) also can include a fluid control system (150) that moves a conductive fluid (138) into the first cavity (136) in a first operational state and at least partially purges the conductive fluid (136) from the first cavity (138) in a second operational state. A conductive path can be provided between the conductive fluid and at least one wall (1116, 118) of the waveguide structure (102).

14 Claims, 4 Drawing Sheets

RF SWITCH USING CONDUCTIVE FLUID

BACKGROUND OF THE INVENTION

1. Statement of the Technical Field

The inventive arrangements relate generally to methods and apparatus for providing increased design flexibility for RF circuits, and more particularly to an RF waveguide switch.

2. Description of the Related Art

A waveguide is a transmission line structure that is commonly used for microwave signals. A number of different waveguide structures are known to those skilled in the art. For instance, a waveguide can simply consist of a hollow tube made of an electrically conductive material, for example copper, brass, steel, etc. Such a waveguide can be provided in a variety of shapes, but most often has a rectangular or circular cross section. A coplanar waveguide is a type of waveguide having a conductor disposed between, and coplanar with, two ground planes. The conductor and ground planes are typically coupled to a dielectric.

As with most other types of electrical circuits, it is often required that a microwave circuit have switches. There are three basic RF and microwave switching technologies currently available, namely electromechanical, ferrite and diode. Electromechanical microwave switches typically are mechanically operated and have low insertion loss and VSWR's of 1.1:1 or better, but switching speed is slow, the switches have a limited life rating, and some of these switches are not practical for hot switching. Hot switching, which is switching while a signal is applied to a switch, can be problematic because voltage reflections can occur while the switch is being operated. Such voltage reflections can damage the circuits with which the switches are used.

Ferrite switches have faster switching speeds than electromechanical waveguide switches, but the VSWR of ferrite switches is not as good as the electromechanical switches. Also, some ferrite switches can have a limited frequency range and/or power handling capability. Diode switches can provide extremely fast switching speeds and are available in very compact packages. However, diode switches have relatively high insertion loss and lower isolation than electromechanical and ferrite switches. Further, the bandwidth of diode switches is fairly narrow. Some of these parameters can be selectively improved, but usually at the sacrifice of other performance parameters.

SUMMARY OF THE INVENTION

The present invention relates to an RF switch which includes a waveguide structure having at least a first and second port. The RF switch also includes a dielectric structure defining at least a first cavity disposed at a juncture between the first and second ports. The dielectric structure can define a plurality of elongated fluid cavities at the juncture extending between opposing walls of the waveguide structure.

The RF switch also can include a fluid control system that moves a conductive fluid into the first cavity in a first operational state and at least partially purges the conductive fluid from the first cavity in a second operational state. A conductive path can be provided between the conductive fluid and at least one wall of the waveguide structure.

A low loss RF path is formed between the first port and the second port in the first or second operational state and the first port is substantially isolated from the second port in a different one of the first and second operational states. For example, the low loss RF path can be formed between the first port and the second port in the first operational state and the first port is substantially isolated from the second port in the second operational state.

The waveguide structure also can include a third port and a second dielectric structure can define at least a second cavity disposed at a juncture between the third port and the waveguide structure. The fluid control system can move the conductive fluid into the second cavity in the second operational state. A low loss RF path can be formed between the first port and the third port in the first or second operational state, and the first port and third port can be substantially isolated in a different one of the first and second operational states. The first and second dielectric structure can be integrally formed as a single unit.

The present invention also relates to a method for controlling a path of an RF signal. The method includes the step of providing a low loss RF path between at least a first and second port of a waveguide in a first operational state. In a second operational state the first port is substantially isolated from the second port by selectively transferring a conductive fluid into at least one cavity of a first dielectric structure within the waveguide. For example, the conductive fluid can be transferred into a plurality of fluid conduits defined within the dielectric structure and extending between opposing walls of the waveguide. A spacing between adjacent ones of the fluid conduits can be selected so as not to exceed about 1/10 of a wavelength at the operating frequency of the waveguide.

In the first operational state, the first port and a third port of the waveguide can be substantially isolated by transferring the conductive fluid into at least one cavity of a second dielectric structure within said waveguide. In the second operational state, a low loss RF path can be formed between the first port and the third port by at least partially purging the conductive fluid from cavity of the second dielectric structure. The first and second dielectric structures can be formed as a single structure.

DETAILED DESCRIPTION OF THE PREFERRED EMBODIMENTS

Figure 1:
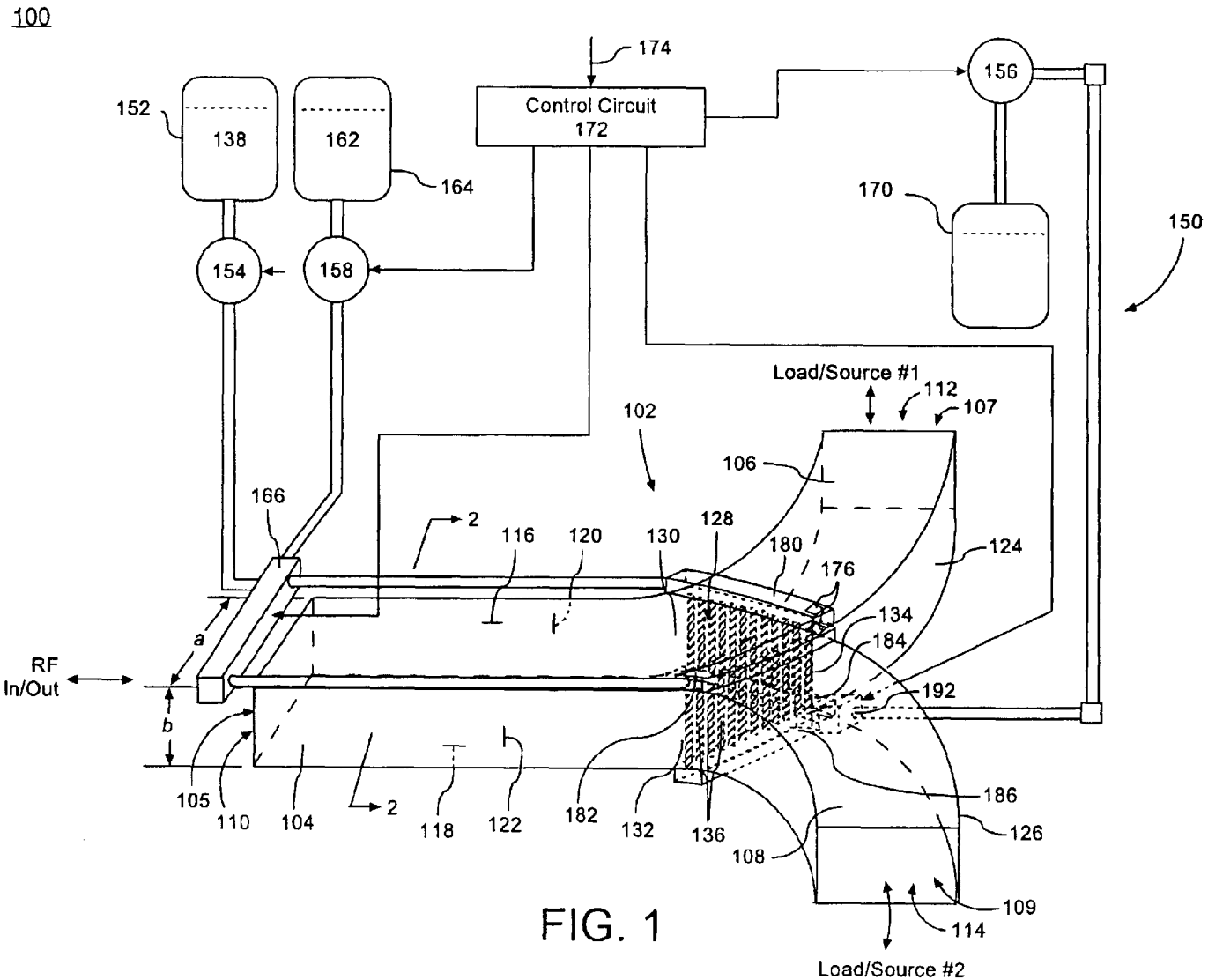
FIG. 1 is a conceptual diagram useful for understanding an RF switch of the present invention.

The present invention relates to a radio frequency (RF) switch which uses a conductive fluid to effectively create a portion of a waveguide wall, thereby defining an RF signal propagation path within the waveguide. Referring to FIG. 1, an RF switch 100 is presented which includes a waveguide structure 102. The waveguide structure 102 includes at least a waveguide portion 104 having a first input/output port (first port) 105 and a second waveguide portion 106 having a second input/output port (second port) 107. The first and second waveguide portions 104, 106 can be tubular sections each having a cavity defined therein. For instance, the first waveguide portion 104 can define a first cavity 110 and the second waveguide portion 106 can define a second cavity 112. A third waveguide portion 108 having a third input/output port (third port) 109 and defining a third cavity 114 also can be provided.

As defined herein, the term tubular describes a shape of a hollow structure having any cross sectional profile. In the present example, the waveguide portions have rectangular cross sectional profiles, however, the present invention is not so limited. Importantly, each of the waveguide portions can have any shape which can define a cavity therein. For example, the waveguide portions 104, 106, 108 each can have a cross sectional profile that is round, square, triangular, or any other shape suitable for propagating RF energy.

In the present example, the first port 105 can receive an RF signal and selectively propagate the RF signal to the second port 107 and/or the third port 109. Nonetheless, the present invention is not so limited. For example, the second and third ports 107, 109 each can receive different RF signals and the RF signals can be selectively propagated to the first port 105. Still, a myriad of other switch configurations can be provided which are within the scope of the present invention.

The intersection of the first and second waveguide portions 104, 106 can form a juncture at a transition region 128. Further, the intersection of the first and third waveguide portions 104, 108 can form a second juncture at the transition region 128. The corresponding second and third cavities 112, 114 can couple to the first cavity 110 at the transition region 128. Further, waveguide portions 106, 108 can extend away from the transition region 128 so as to form a plurality of RF signal propagation paths. For example, a first RF signal propagation path can be defined by the first and second cavities 110, 112, and a second RF signal propagation path can be defined by the first and third cavities 110, 114. The first and second RF signal propagation paths can be divergent, as shown, but again the invention is not so limited. For example, the RF signal propagation paths can be parallel, or oriented in any other suitable switch configuration.

The waveguide switching structure 102 can include opposing waveguide walls (walls) 116, 118, walls 120, 122, and walls 124, 126. In the exemplary arrangement shown, the walls 116, 118 can be contiguous with each of the waveguide portions 104, 106, 108. The walls 120, 122 can be disposed so as to form opposing walls through the first waveguide portion 104. It should be noted that although the walls 120, 122 are shown as being parallel, the walls 120, 122 also can converge or diverge over a length of the first waveguide portion 104, for instance to transition to a waveguide having different dimensions. Further, the walls 120, 122 can diverge where the walls transition from the first waveguide portion 104 to the respective second and third waveguide portions 106, 108. For instance, a first transition 130 can be defined at an intersection of the first waveguide portion 104 with the second waveguide portion 106 and a second transition can be defined at an intersection of the first waveguide portion 104 and the third waveguide portions 108.

Wall 124 can be disposed in opposition to wall 120 in the second waveguide portion 106, and wall 126 can be disposed in opposition to wall 122 in the third waveguide portion 108. An end of each wall 124, 126 can form a wall junction at intersection 134 opposing the respective transitions 130, 132. For example, the intersection 134 can be equidistant from the transitions 130, 132. In one arrangement, the walls 124, 126 can be parallel to respective portions of walls 120, 122. Alternatively, the distance between the opposing walls 120, 124 and opposing walls 122, 126 can vary over a length of the respective waveguide portions 106, 108. For example, the distance between walls 120, 124 and between walls 122, 126 can vary over the length of the respective waveguide portions 106, 108. For instance, the waveguide portions 106, 108 can diverge to form a waveguide horn for free air propagation of an RF signal. Such horns are known to the skilled artisan.

The walls 116, 118, 120, 122, 124, 126 can be electrically conductive. For example, the walls 116, 118, 120, 122, 124, 126 can be formed of a conductive material, such as, brass, copper, aluminum, steel, silver, gold, a conductive alloy, or any other suitable conductor. In one arrangement, the conductive material can be a conductive layer deposited on a suitable substrate.

Figure 2:
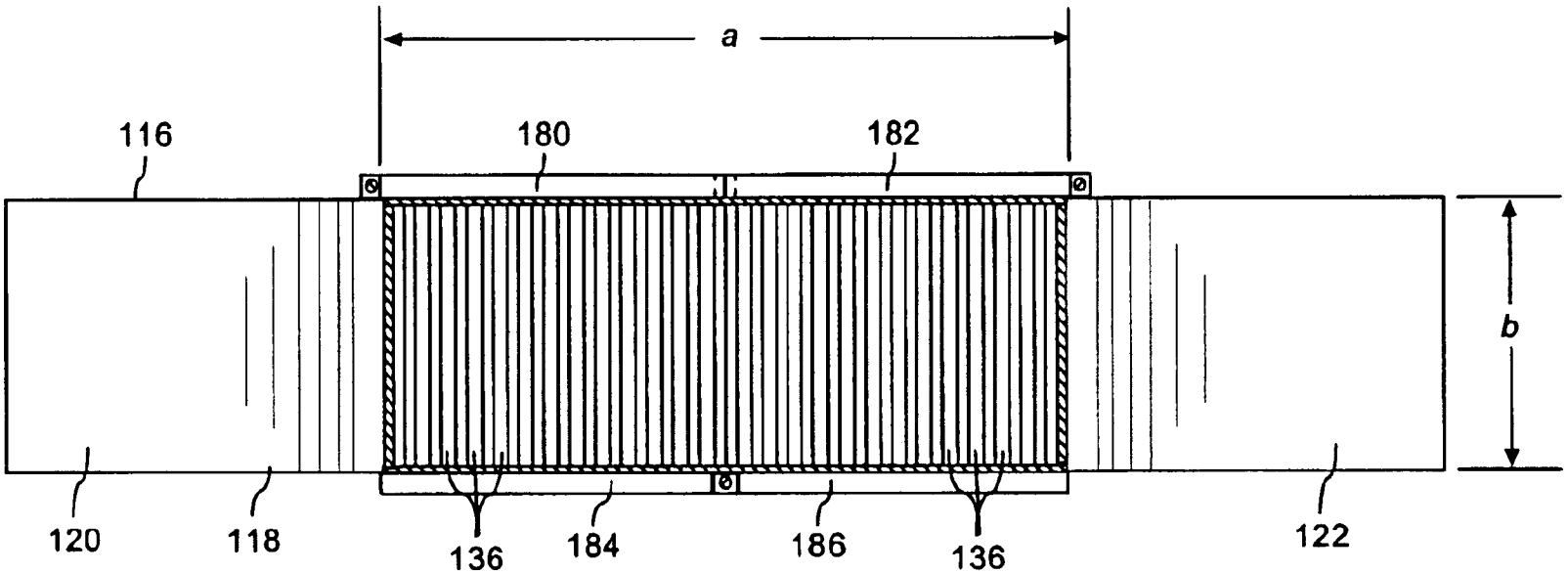
FIG. 2 is a cross-sectional view of a waveguide structure of the RF switch of FIG. 1, taken along section line 2—2.

A cross sectional view of the waveguide structure 102 of FIG. 1 taken along lines 2—2 is shown in FIG. 2. Making reference to both FIGS. 1 and 2, width a of waveguide portion 104 (and waveguide portions 106, 108) can be greater than height b. Accordingly, as the skilled artisan will appreciate, power currents in the waveguide portions 104, 106, 108 typically will be propagated along walls 116, 118 in the dominant $TE_{1,0}$ mode. In particular, in the dominant $TE_{1,0}$ mode the power currents are generated from electric fields which are formed between walls 116, 118. Notably, power currents typically will not propagate on the narrower walls 120, 122, 124, 126 in the $TE_{1,0}$ mode because, in general, significant electric fields do not form between these walls. Accordingly, the waveguide performance of a waveguide structure having gaps along a narrow wall will not be adversely affected to a significant extent so long as the spacing of the gaps are less than 1/10 of a wavelength at the operational frequency.

One or more fluid conduits 136 having cavities, can extend from wall 116 to wall 118. The fluid conduits 136 can be any conduits that can contain a conductive fluid 138 so that electrical continuity can be provided between the waveguide walls 116, 118 and the conductive fluid 138. In particular, the fluid conduits 136 can be channels, tubes, elongated cavities, or any other type of dielectric cavity which extends from a first portion of the waveguide to a second portion of the waveguide. The fluid conduits 136 can be glass, plastic, ceramic or any other dielectric material which can contain the conductive fluid 138 therein.

In one arrangement, a dielectric material can be disposed between the walls 116, 118. In such an arrangement, the fluid conduits 136 can be bores or vias that extend from wall 116, through the dielectric to wall 118. Alternatively, the bores can extend through the walls 116, 118 as well. Moreover, the fluid conduits 136 can extend from, or to, any of the walls, and the fluid conduits 136 can be disposed to create differing waveguide structures.

Figure 3B:
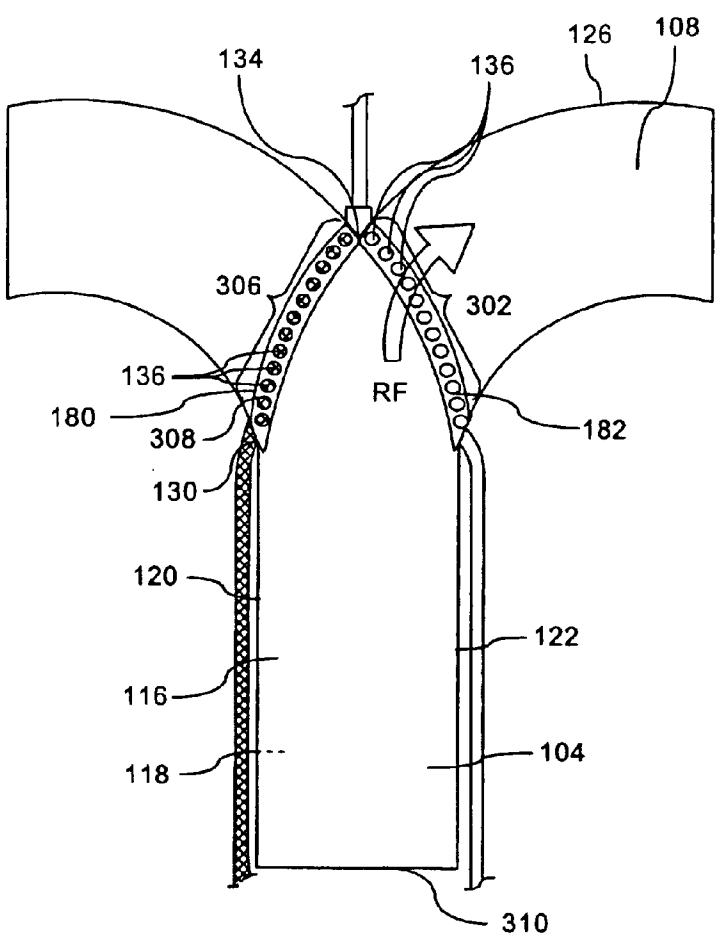
FIG. 3B is a top view of the waveguide structure of FIG. 1 in a second operational state.
Figure 3A:
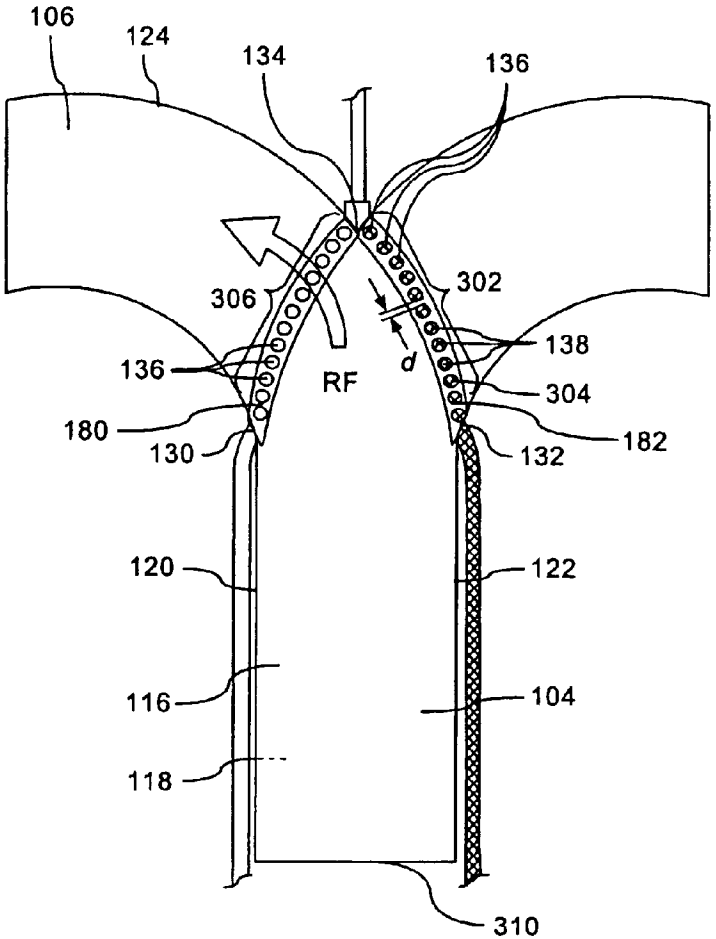
FIG. 3A is a top view of the waveguide structure of FIG. 1 in a first operational state.

Referring to FIG. 3A, a top view of the waveguide structure 102 in a first operational state is shown. In the first operational state, the conductive fluid 138 can be injected into a first dielectric structure 302 having fluid conduits 136, thereby creating a plurality of conductive regions which create a first effective wall 304 disposed between transition 132 and intersection 134. In a preferred arrangement, the spacing d between adjacent fluid conduits is less than or equal to 1/10 of a wavelength of the operational frequency.

In the first operational state, the conductive fluid 138 can be absent from a second dielectric structure 306 disposed between transition 130 and intersection 134. For instance, the conductive fluid 138 can be purged from fluid conduits 136 associated with the second dielectric structure 306. For example, a vacuum or positive pressure can be used to purge the conductive fluid 138 from the fluid conduits 136. In one arrangement, the conductive fluid 138 can be replaced with a fluid dielectric 162 or a gas. The fluid dielectric or gas can be any fluid or gas which can be injected in the fluid conduits 136 to remove the conductive fluid 138 from the fluid conduits. The first and second dielectric structures 302, 306 can be integrally formed.

A typical fluid dielectric can be, for example, an oil such as Vacuum Pump Oil MSDS-12602, a solvent, such as formamide, water, etc. Typical gases can include air, nitrogen, helium, and so on. Importantly, the invention is not limited to any particular fluid dielectric 162 or gas. Those skilled in the art will recognize that the examples of fluid dielectric or gas as disclosed herein are merely by way of example and are not intended to limit in any way the scope of the invention.

During the first operational state, a first effective waveguide structure can be formed which is defined by a first wall comprising a portion of wall 122 extending from an input 310 to the transition 132, the effective waveguide wall 304, and wall 124. The first waveguide structure is also defined by wall 120 and walls 116, 118. Accordingly, a low loss RF path is provided between the first and second ports 105, 107.

Referring to FIG. 3B, a top view of the waveguide structure 102 in a second operational state is shown. In the second operational state the conductive fluid 138 can be injected into the fluid conduits 136 in the second dielectric structure 306 to create a second effective wall 308 disposed between transition 130 and intersection 134. Again, it is preferred that the spacing of the fluid conduits 136 be equal to or less than 1/10 of a wavelength. In the second operational state, the conductive fluid 138 can be absent, or purged, from the first dielectric structure 302. Accordingly, a second effective waveguide structure can be formed which is defined by a second wall comprising a portion of wall 120 extending from the input 310 to the transition 130, the effective waveguide wall 308, and wall 126. The second waveguide structure is also defined by wall 122 and walls 116, 118. Accordingly, a low loss RF path is formed between first port 105 and third port 109.

In a third operational state, the conductive fluid can be absent, or purged, from the fluid conduits 136 of both the first and second dielectric structures 302, 306. In the third operational state, a low loss RF path is provided between the first port 105 and both the second and third ports 107, 109.

Lastly, in a fourth operational state the conductive fluid 138 can be injected into the fluid conduits 136 of both first and second dielectric structures 302, 306, thereby implementing both walls 304, 308. It should be noted, however, that voltage reflections can result from an RF signal being propagated through the first waveguide portion 104 during the fourth operational state. Likewise, voltage reflections can result from propagating an RF signal through the third waveguide portion 108 in the first or fourth operational states, and voltage reflections can result from propagating an RF signal through the second waveguide portion 106 during the second or fourth operational states.

Figure 4A:
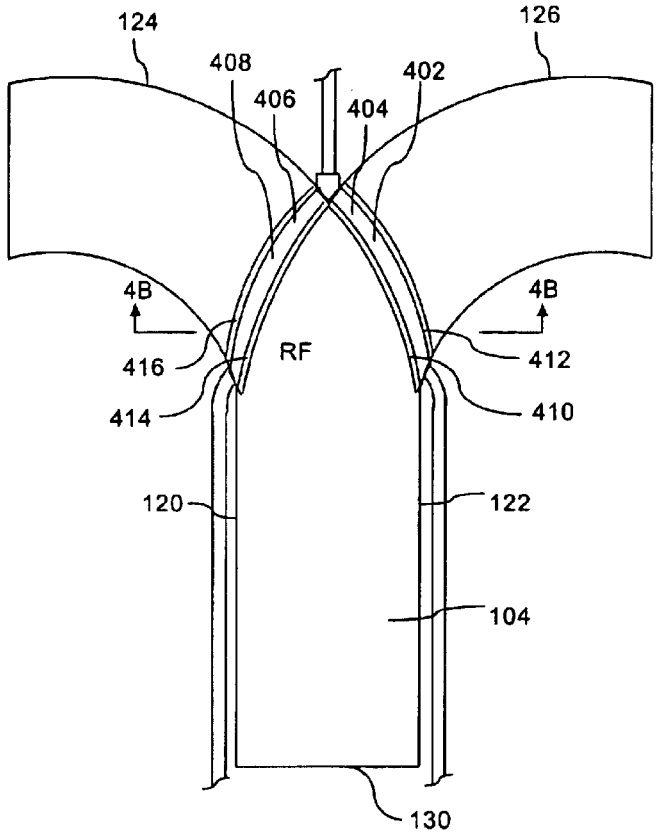
FIG. 4A is a top view of an alternate arrangement of the waveguide structure of FIG. 1.
Figure 4B:
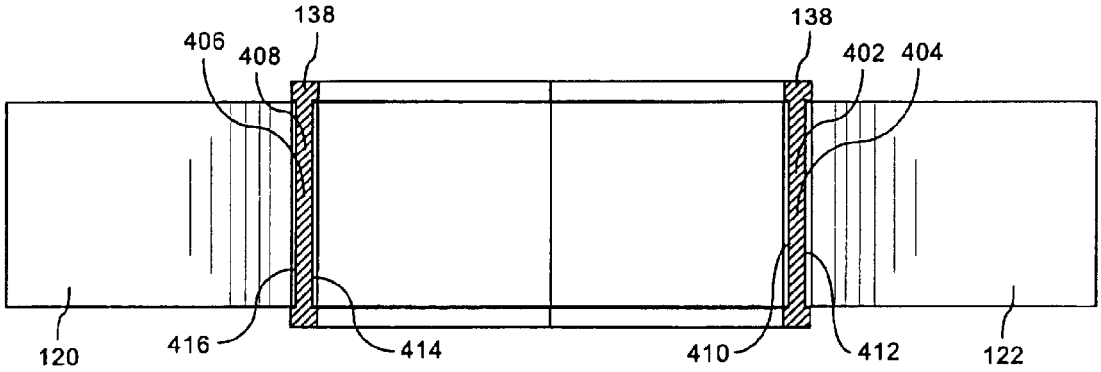
FIG. 4B is a cross-sectional view of the waveguide structure of FIG. 4A, taken along section line 4B—4B.

Referring to FIG. 4A, an alternative embodiment for a waveguide structure 102 is shown wherein dielectric walls define a first cavity 402 and a second cavity 406 within the waveguide structure 102. A cross-sectional view taken along section lines 4B—4B is shown in FIG. 4B. The first cavity 402 can be bounded by walls 122, 126 and dielectric walls 410, 412. The dielectric walls 410, 412 can be glass, plastic, or any other dielectric material which can prevent leakage of the conductive fluid 138 from the cavity 402. Accordingly, the dielectric walls 410, 412 can maintain the conductive fluid 138 within the cavity 402 to define a first effective wall 404, while having an insignificant impact on waveguide performance when the conductive fluid 138 is not present in the cavity 402.

Likewise, the second cavity 406 can be bounded by walls 120, 124 and dielectric walls 414, 416. Again, the dielectric walls 414, 416 can be glass, plastic, or any other dielectric material which can prevent leakage of the conductive fluid 138 from the cavity 406. Accordingly, the dielectric walls 414, 416 can maintain the conductive fluid 138 within the cavity 406 to define the second effective wall 408, also while having an insignificant impact on waveguide performance when the conductive fluid 138 is not present in the cavity 406.

The conductive fluid 138 can be injected into the cavity 402 and purged from the cavity 406 during the first operational state. Further, the conductive fluid 138 can be injected into the cavity 406 and purged from the cavity 402 in the second operational state. The conductive fluid 138 can be purged from both cavities 402, 406 in the third operational state and injected into both cavities 402, 406 in the fourth operational state.

Fluid Control System

Referring once again to FIG. 1, it can be seen that the invention preferably includes a fluid control system 150 for selectively controlling the presence and/or removal of the conductive fluid 138 from the fluid conduits 136. The fluid control system 150 also can be used for selectively controlling the presence and/or removal of the conductive fluid 138 from the cavities 402, 406 of FIGS. 4A and 4B. However, for convenience, the operation of the fluid control system shall be described relative to FIGS. 1, 2 and 3. The fluid control system can comprise any suitable arrangement of pumps, valves and/or conduits that are operable for effectively injecting and/or removing the conductive fluid 138 from the fluid conduits 136. A wide variety of such fluid control systems may be implemented by those skilled in the art. For example, in one embodiment, the fluid control system can include a reservoir 152 for the conductive fluid 138 and a pump 154 for injecting the conductive fluid 138 into the fluid conduits 136.

The conductive fluid 138 can be injected into the fluid conduits 136 by means of suitable injection fluid transfer conduits 180, 182. Discharge fluid transfer conduits 184, 186 can also be provided for permitting the conductive fluid 138 to be purged from the fluid conduits 136. Fluid valves 166, 192 can be provided to control fluid transfer to the fluid transfer conduits 180, 182, 184, 186 and the fluid conduits 136. The fluid valves 166, 192 can be operated as appropriate to transfer fluid into the fluid transfer conduits 136 of the first dielectric structure to contain the conductive fluid 138 within the dielectric structure 302 during the first operational state, and purged from the fluid conduits 136 of the first dielectric structure 302 in the second operational state. Likewise, the fluid valves 166, 192 can be operated as appropriate to transfer fluid into the fluid transfer conduits 136 of the second dielectric structure 306 to contain the conductive fluid 138 within the second dielectric structure 306 during the second operational state, and purged from the fluid conduits 136 of the second dielectric structure 306 in the first operational state. In one embodiment the fluid valves 166, 192 can be mini-electromechanical or micro-electromechanical systems (MEMS) valves, which are known to the skilled artisan.

One or more sensors 176 can be provided to verify the presence of the conductive fluid in the fluid conduits. For example, resistance sensors can be provided in the fluid transfer conduits 180, 182 which detect whether a conductive fluid is present in the fluid transfer conduits 180, 182. The resistance sensors can detect the presence of the conductive fluid by determining whether a fluid with low resistance is present in the fluid transfer conduits 180, 182. Sensor readings which verify that the conductive fluid is present in the fluid transfer conduits 180, 182 can be indicative of conductive fluid being present in the fluid conduits 136. Alternatively, sensors can be provided for individual fluid conduits 136.

When it is desired to purge the conductive fluid 138 from any set of fluid conduits 136, a pump 156 can be used to draw the conductive fluid 138 from the fluid conduits 136 into a recovery reservoir 170. Alternatively, in order to ensure a more complete removal of all conductive fluid from the fluid conduits 136, one or more pumps 158 can be used to inject a dielectric solvent 162 into the fluid conduits 136. The dielectric solvent 162 can be stored in a second reservoir 164 and can be useful for ensuring that the conductive fluid 138 is completely and efficiently flushed from the fluid conduits 136. The fluid valve 166 can be used to selectively control the flow of conductive fluid 138 and dielectric solvent 162 into the fluid conduits 136. The sensors 176 can detect whether the conductive fluid has been completely purged from the fluid conduits.

A mixture of the conductive fluid 138 and any excess dielectric solvent 162 that has been purged from the fluid conduits 136 can be collected in the recovery reservoir 170. For convenience, additional fluid processing, not shown, can also be provided for separating dielectric solvent from the conductive fluid contained in the recovery reservoir for subsequent reuse. However, the additional fluid processing is a matter of convenience and not essential to the operation of the invention.

A control circuit 172 can be configured for controlling the operation of the fluid control system 150 in response to an analog or digital fluid control signal 174. For example, the control circuit 172 can control the operation of the fluid valves 166, 192 and pumps 154, 156, 158 necessary to selectively control the presence and removal of the conductive fluid 138 and the dielectric solvent 162 from the fluid conduits 136. It should be understood that the fluid control system 150 is merely one possible implementation among many that could be used to inject and purge conductive fluid from the fluid conduits 136 and the invention is not intended to be limited to any particular type of fluid control system. All that is required of the fluid control system is the ability to effectively control the presence and removal of the conductive fluid 138 from the fluid conduits 136.

Composition of Conductive Fluid

According to one aspect of the invention, the conductive fluid used in the invention can be selected from the group consisting of a metal or metal alloy that is liquid at room temperature. The most common example of such a metal would be mercury. However, other electrically-conductive, liquid metal alloy alternatives to mercury are commercially available, including alloys based on gallium and indium alloyed with tin, copper, and zinc or bismuth. These alloys, which are electrically conductive and non-toxic, are described in greater detail in U.S. Pat. No. 5,792,236 to Taylor et al, the disclosure of which is incorporated herein by reference. Other conductive fluids include a variety of solvent-electrolyte mixtures that are well known in the art.

A system which relies on the presence or absence of a conductive fluid must ensure that no conductive residue remains in/on the walls of the fluid conduits when fluid conduits need to be in the purged state. It is believed that cases exist which illustrate that this condition can be met, in some instances with a passive system. An example is a commonly used mercury thermometer. As the mercury, which is a conductive liquid, is drawn down the tube in response to decreasing temperature the surface tension of the fluid draws all material along and does not leave "residue" or particulate matter on the sides of the transport tube. For other conductive fluids which may consist of particles in solution or suspension, an active purging system may be employed which uses a nonconductive fluid to flush the fluid conduits of any remaining conductive particles.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. An RF switch comprising:

a waveguide structure having at least a first and second port;

a dielectric structure defining at least a first cavity disposed at a juncture between said first and second ports; and a fluid control system that moves a conductive fluid into said first cavity in a first operational state and at least partially purges said conductive fluid from said first cavity in a second operational state, and wherein a low loss RF path is formed between said first port and said second port in at least one of said first and second operational states, said first port being substantially isolated from said second port in a different one of said first and second operational states.

2. The RF switch according to claim 1 wherein said low loss RF path is formed between said first port and said second port in said first operational state and said first port is substantially isolated from said second port in said second operational state.

3. The RF switch according to claim 1 wherein said waveguide structure has a third port, and a second dielectric structure defines at least a second cavity disposed at a juncture between said third port and said waveguide structure.

4. The RF switch according to claim 3 wherein said fluid control system moves said conductive fluid into said second cavity in said second operational state.

5. The RF switch according to claim 3 wherein a low loss RF path is formed between said first port and said third port in one of said first and second operational state, and said first port and said third port are substantially isolated in a different one of said first and second operational states.

6. The RF switch according to claim 3 wherein said first and second dielectric structure are integrally formed as a single unit.

7. The RF switch according to claim 1 wherein said dielectric structure defines a plurality of elongated fluid cavities at said juncture extending between opposing walls of said waveguide structure.

8. The RF switch according to claim 1 wherein a conductive path is provided between said conductive fluid and at least one wall of said waveguide structure.

9. A method for controlling a path of an RF signal, comprising the steps of:

providing a low loss RF path between at least a first and second port of a waveguide in a first operational state; and substantially isolating said first port from said second port in a second operational state by selectively transferring a conductive fluid into at least one cavity of a first dielectric structure within said waveguide.

10. The method according to claim 9 further comprising the step of transferring said conductive fluid into a plurality of fluid conduits defined within said dielectric structure and extending between opposing walls of said waveguide.

11. The method according to claim 10 further comprising the step of selecting a spacing between adjacent ones of said fluid conduits so as not to exceed about 1/10 of a wavelength at the operating frequency of the waveguide.

12. The method according to claim 9 further comprising the step of substantially isolating said first port and a third port of said waveguide in said first operational state by transferring said conductive fluid into at least one cavity of a second dielectric structure within said waveguide.

13. The method according to claim 12 further comprising the step of forming a low loss RF path between said first port and said third port in said second operational state by at least partially purging said conductive fluid from said at least one cavity of said second dielectric structure.

14. The method according to claim 12 further comprising the step of integrally forming said first and second dielectric structures as a single structure.

* * * * *